US008348249B2

(12) United States Patent
Cotter

(10) Patent No.: US 8,348,249 B2
(45) Date of Patent: Jan. 8, 2013

(54) REACTION DEVICE FOR FORMING EQUIPMENT

(75) Inventor: Jonathan P. Cotter, Dearborn, MI (US)

(73) Assignee: DADCO, Inc., Plymouth, MI (US)

( * ) Notice: Subject to any disclaimer, the term of this patent is extended or adjusted under 35 U.S.C. 154(b) by 654 days.

(21) Appl. No.: 12/568,736

(22) Filed: Sep. 29, 2009

(65) Prior Publication Data

US 2010/0083726 A1 Apr. 8, 2010

Related U.S. Application Data

(60) Provisional application No. 61/103,329, filed on Oct. 7, 2008.

(51) Int. Cl.
*B21D 22/00* (2006.01)

(52) U.S. Cl. ..... 267/118; 72/21.5; 72/350; 60/563

(58) Field of Classification Search ..... 72/350, 72/351, 21.5; 60/563, 566, 567, 574, 581; 92/52; 267/118, 119, 130
See application file for complete search history.

(56) References Cited

U.S. PATENT DOCUMENTS

| | | | | |
|---|---|---|---|---|
| 3,085,530 A | | 4/1963 | Williamson | |
| 5,065,606 A | * | 11/1991 | Kadis | 72/348 |
| 5,687,598 A | * | 11/1997 | Kirii et al. | 72/21.5 |
| 5,927,178 A | * | 7/1999 | Stenquist | 92/52 |
| 5,966,981 A | * | 10/1999 | Janos et al. | 72/350 |
| 5,996,981 A | | 12/1999 | Dilling | |
| 6,170,809 B1 | | 1/2001 | Cotter | |
| 6,295,813 B1 | | 10/2001 | Stenquist | |
| 7,331,570 B2 | | 2/2008 | Stenquist | |
| 7,739,871 B2 | * | 6/2010 | Cotter et al. | 60/563 |
| 2004/0187546 A1 | * | 9/2004 | Kodani | 72/350 |
| 2006/0207247 A1 | * | 9/2006 | Nagai et al. | 60/413 |
| 2009/0283943 A1 | | 11/2009 | Bordignon | |

FOREIGN PATENT DOCUMENTS

| | | |
|---|---|---|
| DE | 2332299 A1 | 1/1974 |
| DE | 2742405 A1 | 3/1979 |
| DE | 3230669 A1 | 5/1983 |
| EP | 1500843 A2 | 1/2005 |
| EP | 1888269 B1 | 1/2010 |

OTHER PUBLICATIONS

European Search Report, Feb. 17, 2010 (7 pages).

* cited by examiner

*Primary Examiner* — Christopher Schwartz
(74) *Attorney, Agent, or Firm* — Reising Ethington P.C.

(57) ABSTRACT

An apparatus may have a cylinder including a piston rod and a chamber in which a working fluid is received to resist movement of the piston rod into the chamber, and an accumulator having a first chamber in communication with the cylinder chamber to receive fluid from the cylinder chamber upon movement of the piston rod into the cylinder chamber. The apparatus may also have a pressure controller having a fluid chamber where some of the working fluid may be received and an actuator operable to increase the volume of the fluid chamber when the piston rod is retracted into the cylinder chamber to increase the total volume in which the working fluid may be received, wherein the increased volume of the fluid chamber may accommodate fluid movement in the assembly not caused by movement of the piston rod.

19 Claims, 5 Drawing Sheets

REACTION DEVICE FOR FORMING EQUIPMENT

REFERENCE TO RELATED APPLICATIONS

This application claims the benefit of, and incorporates by reference in its entirety, U.S. Provisional Application Ser. No. 61/103,329, filed Oct. 7, 2008.

TECHNICAL FIELD

This disclosure relates generally to forming equipment and more particularly to a reaction device that may be used with forming equipment

BACKGROUND

Gas springs commonly are used in various implementations in forming equipment to provide a moveable component or support of a forming die or a workpiece with a yielding force or a return force. For example, in a binder ring implementation, gas springs may provide a yielding force against a binder ring of a forming die to hold a metal workpiece while a press ram forms the workpiece. The gas springs may also temporarily hold the workpiece while the press ram retracts.

SUMMARY OF THE DISCLOSURE

An apparatus may have a cylinder including a piston rod and a chamber in which a working fluid is received to resist movement of the piston rod into the chamber, and an accumulator having a first chamber in communication with the cylinder chamber to receive fluid from the cylinder chamber upon movement of the piston rod into the cylinder chamber. The apparatus may also have a pressure controller having a fluid chamber in which some of the working fluid may be received and an actuator operable to increase the volume of the fluid chamber when the piston rod is retracted into the cylinder chamber to increase the total volume in which the working fluid may be received, wherein the increased volume of the fluid chamber may accommodate fluid movement in the assembly not caused by movement of the piston rod.

In one implementation, a reaction device for forming equipment may include a cylinder, an accumulator and a pressure controller. The cylinder may include a piston rod having one end extending out of the cylinder and a chamber in which a working fluid is received to resist movement of the piston rod into the chamber. The accumulator may have a first chamber in communication with the cylinder chamber to receive fluid from the cylinder chamber upon movement of the piston rod into the cylinder chamber, a second chamber in which a compressible fluid is received, and a piston disposed between and defining part of both the first chamber and the second chamber. The pressure controller may communicate with a fluid chamber in which some of the working fluid may be received and have an actuator operable to increase the volume of the working fluid in the fluid chamber when the piston rod is retracted into the cylinder chamber, wherein the fluid chamber communicates with the cylinder chamber and the fluid chamber receives working fluid from the cylinder chamber to accommodate changes in pressure in the working fluid not caused by movement of the piston rod to prevent unintended movement of the piston rod.

BRIEF DESCRIPTION OF THE DRAWINGS

The following detailed description of exemplary embodiments and best mode will be set forth with reference to the accompanying drawings, in which.

DETAILED DESCRIPTION OF PREFERRED EMBODIMENTS

Figure 1:
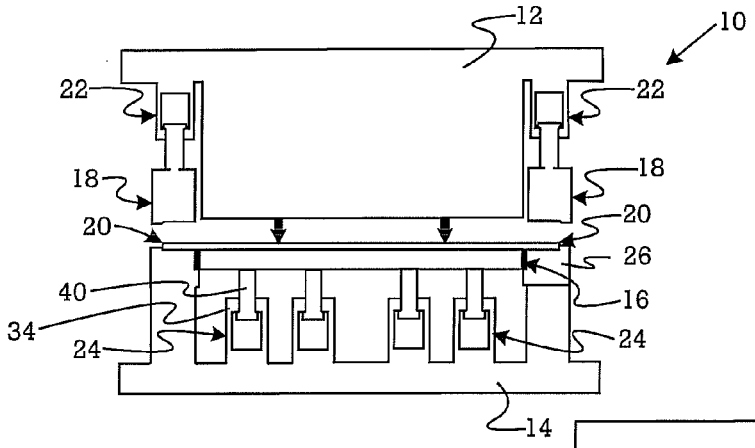
FIG. 1 is a diagrammatic side view of one implementation of forming equipment including a plurality of reaction devices shown in a position prior to forming a part.

Referring in more detail to the drawings, FIGS. 1-4 illustrate forming equipment such as a press 10 including a ram 12 for forming a part, a base 14, a moveable lower pad 16 and a clamp ring 18 to hold a periphery of the blank 20 to be formed (the "blank" is the material to be formed). Gas springs 22 may be carried by the press ram 12 and may engage the clamp ring 18 to provide controlled movement of the clamp ring 18 as a function of the movement of the press ram 12. Reaction devices 24 carried by the press (e.g. the base 14) support the lower pad 16 for controlled movement of the lower pad during part formation, and to facilitate removal of the part from the press 10 after a forming cycle.

Figure 3:
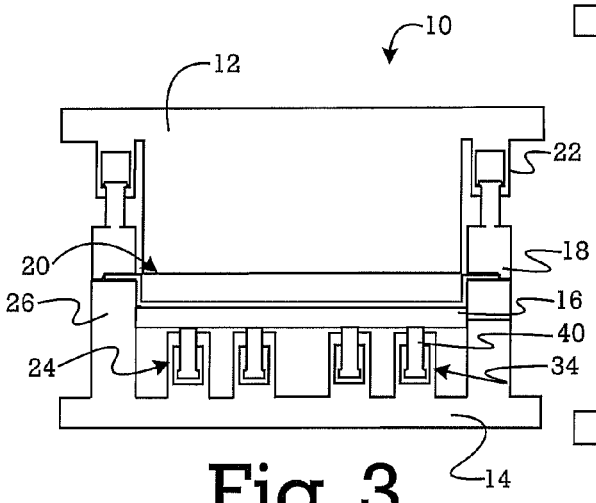
FIG. 3 is a diagrammatic side view of the forming equipment shown in an intermediate retracted position after the part has been formed.
Figure 4:
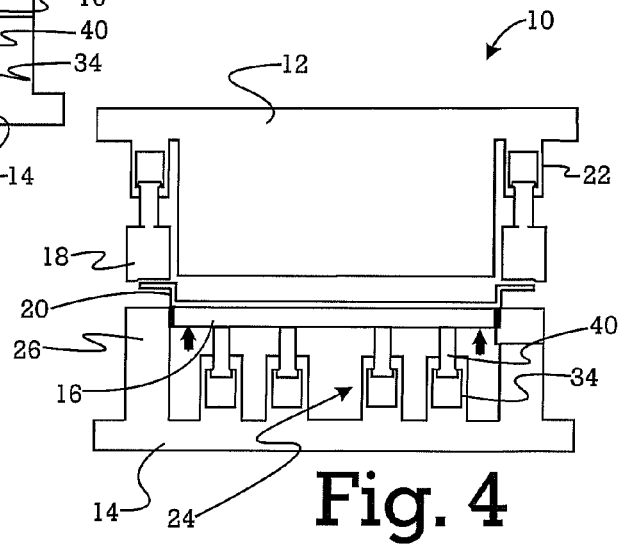
FIG. 4 is a diagrammatic side view of the forming equipment shown in a fully retracted position.
Figure 5:
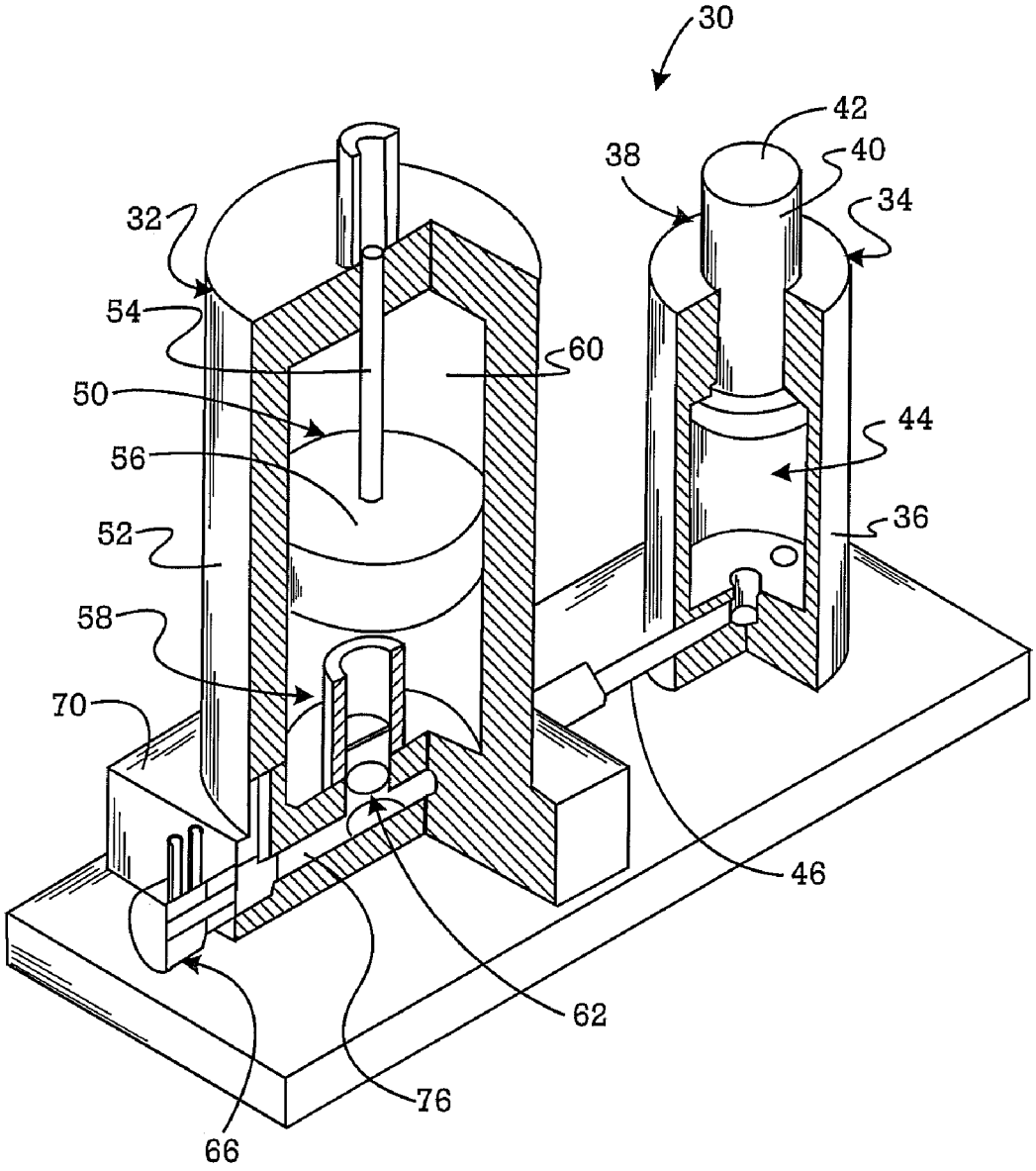
FIG. 5 is a perspective view of an exemplary reaction device with portions cut away.
Figure 6:
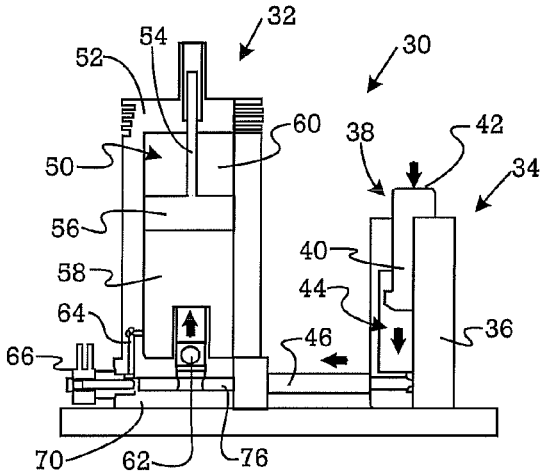
FIG. 6 is a side view partially in section of the device of FIG. 5 shown in a first state.
Figure 7:
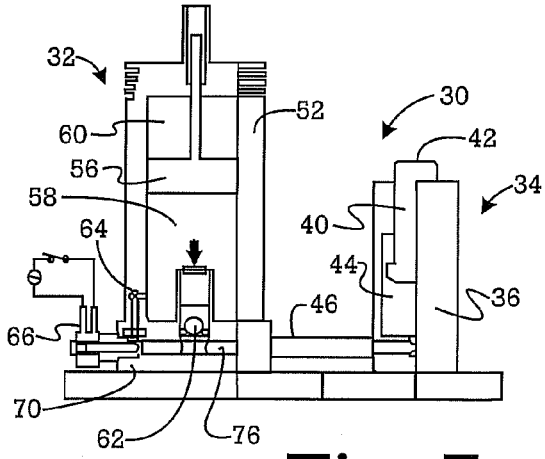
FIG. 7 is a side view partially in section of the device of FIG. 5 shown in a second state.
Figure 8:
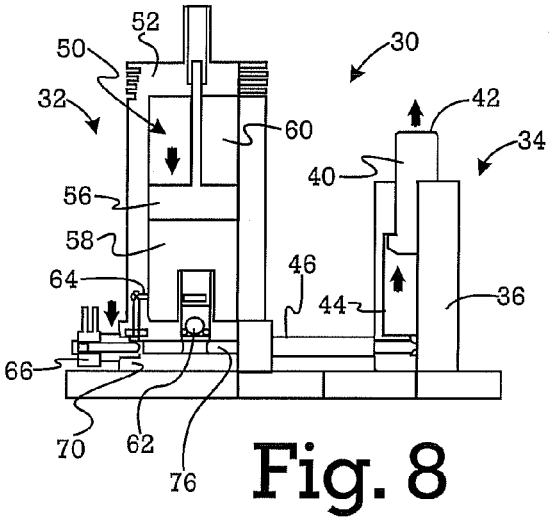
FIG. 8 is a side view partially in section of the device of FIG. 5 shown in a third state.

As shown in FIG. 1, prior to initiating a forming cycle, the lower pad 16 is extended toward the ram 12 by the reaction devices 24, a blank 20 is disposed on the lower pad 16 and a peripheral support 26 of the base 14, and the press ram 12 and clamp ring 18 are initially fully retracted from the blank 20. The press ram 12 is then advanced to the position shown in FIG. 2 to form the blank 20. During this movement of the ram 12, the ram 12 and clamp ring 18 engage the blank 20. The clamp ring 18 holds the blank 20 at its periphery against the support 26, and the ram 12 traps the blank 20 against the lower pad 16. Further movement of the ram 12 displaces the lower pad 16 against the force of the reaction devices, and forms the blank 20 into a desired shape. As shown in FIG. 3, after the blank 20 has been formed, the press ram 12 is retracted while, in this implementation, the gas springs 22 and the reaction devices 24 include control mechanism intended to delay return movement of these devices to hold the position of the formed blank 20 while the ram 12 initially retracts. As shown in FIG. 4, the formed blank 20 may be lifted toward the ram 12 to facilitate removal of the formed blank 20 from the press 10 upon sufficient retraction of the ram 12, and movement of the gas springs 22 and reaction devices 24.

At least a portion of an exemplary reaction device assembly 30 is shown in FIGS. 5-8. The reaction device assembly 30 may include an accumulator 32 and a spring cylinder 34. The spring cylinder 34 may include a casing 36 with an open end 38, and a piston rod 40 received partially within the casing 36 for reciprocation relative to the casing, and having a free end 42 extending out of the casing 36. When used with a press 10 constructed and arranged as shown in FIGS. 1-4, the free end 42 of the piston rod 40 may engage the lower pad 16. A pressure chamber 44 in the spring cylinder 34 may be filled with a working fluid (such as hydraulic fluid) the pressure of which may increase as the piston rod 40 is displaced further into the casing 36 during a stroke of the press ram 12. The pressure chamber 44 may be communicated with the accumulator 32 through a first passage which may be called a transfer passage 46.

The accumulator 32 may include a piston rod assembly 50 and a casing 52. The piston rod assembly 50 may include a piston rod 54 and a piston 56 connected to the rod 54 for conjoint reciprocation relative to the casing 52. The piston 56 may carry a seal (not shown) that seals against the casing 52 to divide the casing interior into and define part of two chambers. A first chamber 58 may be communicated with the pressure chamber 44 of the spring cylinder 34 to receive hydraulic fluid therein. A second chamber 60 may contain a compressible fluid, such as a gas like nitrogen under pressure and acting on the piston 56 to provide a force on the hydraulic fluid in the first chamber 58 and the pressure chamber 44. A check valve 62 may be disposed between the pressure chamber 44 and the first chamber 58 to permit fluid flow from the pressure chamber 44 to that first chamber 58, but prevent the reverse flow of fluid. The first chamber 58 may also communicate with the pressure chamber 44 through a second passage 64 which may be selectively closed by a valve, such as a solenoid valve 66 to facilitate control of the fluid flow through the second passage 64. As shown, the second passage 64 may be joined with the transfer passage 46 and provide a bypass around the check valve 62 when the solenoid valve 66 is open to permit fluid flow through the second passage 64. A portion of the piston rod 54 may extend out of the casing 52 and may include indicia to provide an indication of the hydraulic fluid level in the assembly in a given position of the piston 56 (e.g. when the piston 56 is fully retracted providing a maximum volume of the first chamber 58).

Figure 9:
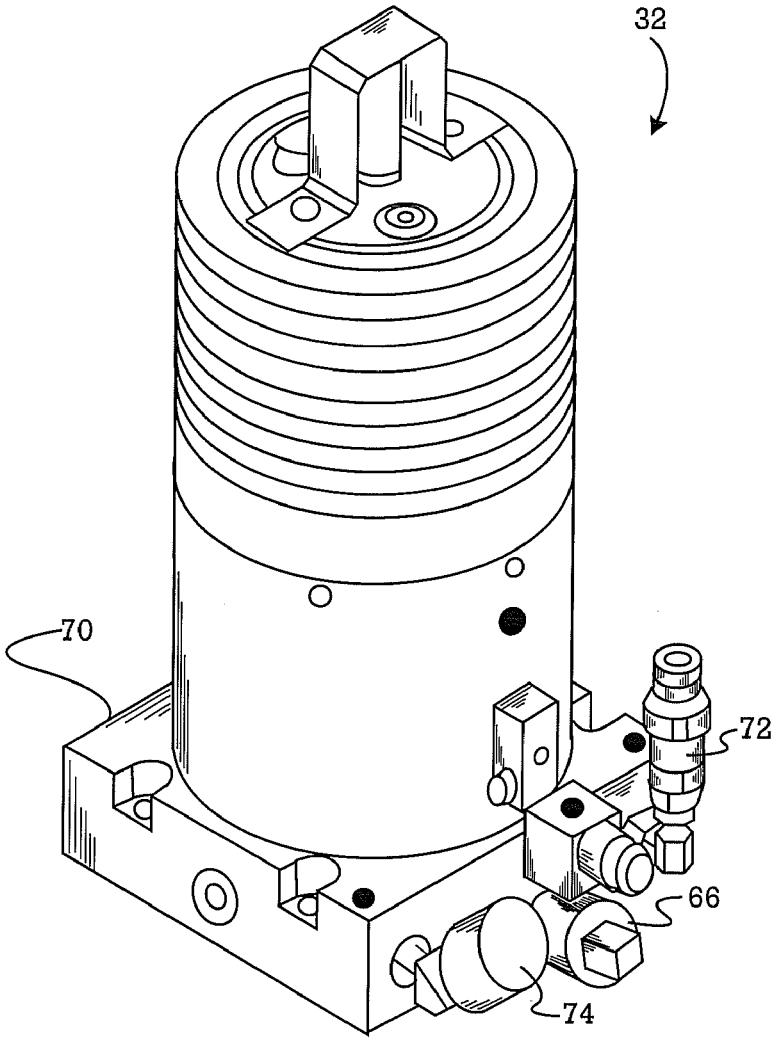
FIG. 9 is a perspective view of an exemplary accumulator of the device shown in FIG. 5.

The accumulator 32 may include a block 70 that defines part of the casing 52. As shown in FIG. 9, the block 70 may carry the solenoid valve 66, a fitting 72 through which hydraulic fluid may be added to or removed from the system; and a pressure gauge 74 or other instrumentation, valve or device. At least a portion 76 of the transfer passage 46 may be formed in the block 70, and the remainder of the transfer passage 46 may be formed by a tube, conduit, passage or other component leading to the spring cylinder.

Figure 13:
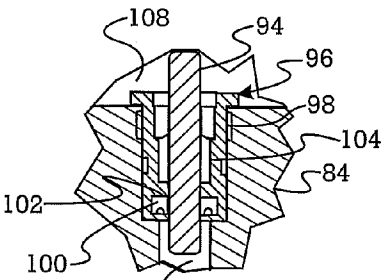
FIG. 13 is an enlarged fragmentary view of the encircled portion 13 in FIG. 12.
Figure 12:
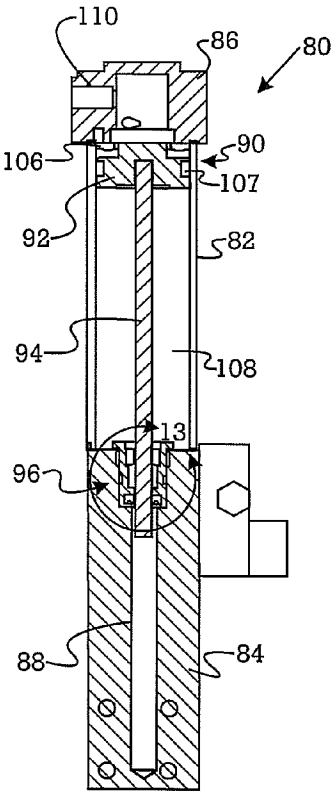
FIG. 12 is a sectional view of a pressure controller taken along line 12-12 in FIG. 11.
Figure 10:
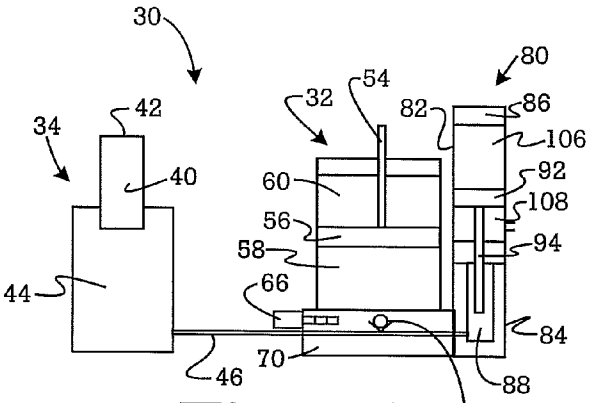
FIG. 10 is a diagrammatic view of a reaction device assembly with a pressure controller.
Figure 11:
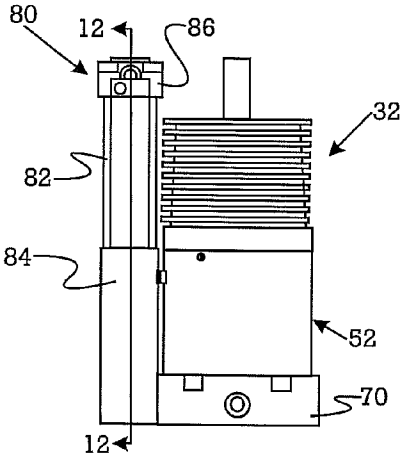
FIG. 11 is a side view of a portion of the reaction device assembly shown in FIG. 10.

As best shown in FIG. 10, the transfer passage 46 may also be communicated with a pressure controller 80. As shown in FIGS. 11 and/or 12, the pressure controller 80 may include an open-ended cylinder 82, a base 84 at one end of the cylinder 82 which may be mounted on the block 70, and a head 86 at the other end of the cylinder 82. A bore 88 in the base 84 defines a fluid chamber, and an actuator 90 is moveable relative to the fluid chamber to vary the volume of the fluid chamber. The actuator 90 may include a piston assembly with a piston 92 slidably received in the cylinder 82 and a rod 94 extending from or otherwise carried by the piston 94 and received through a bearing and seal assembly 96 into the bore 88. As best shown in FIG. 13, the bearing and seal assembly 96 may include a retainer cartridge 98 having an annular rod seal 100 encircling the rod 94 and backed-up by a radially inwardly extending flange 102. A bearing 104 may also be carried by the retainer cartridge 98 to guide reciprocation of the rod 94. The piston 92 may carry a seal and/or a bearing 107 to guide its reciprocation. The seal 107 preferably defines an actuation chamber 106 above the piston 92 (above as viewed in FIG. 12), and prevents leakage around the piston 92 into a second chamber 108 between the actuation chamber 106 and the rod seal 100. The second chamber 108 may be vented to atmosphere to prevent a vacuum from forming during reciprocation of the piston. Or the system could be dual acting with a pressure source also applied to the second chamber 108, where the force of such pressure source would act against the force of the fluid in the actuation chamber 106. Fluid may be admitted into or vented from the actuation chamber through a control valve 109 to vary the pressure in the actuating chamber 106. The fluid may be compressible.

As shown in FIG. 10, the transfer passage 46 is communicated with the bore 88, while a pressurized actuating fluid is communicated with the piston 92 via a suitable passage 110 (FIG. 12) in the head 86 leading to the actuation chamber 106. A first surface area of the piston 92 upon which the actuating fluid acts may be larger than a second surface area defined by the rod 94 upon which the hydraulic fluid acts so that a given pressure of the actuating fluid can offset a comparatively high pressure of hydraulic fluid. The first surface area may be significantly larger than the second surface area, such as 15-60 times larger. In one implementation, the piston's surface area is about 39 times greater than the opposing area of the rod 94 so that the actuating fluid can hold the piston assembly in place against a hydraulic fluid pressure that is 39 times greater than the actuating fluid pressure. Of course, other sizes can be used, as desired.

In use, the actuating fluid (which, as an example, could be a pressurized gas like compressed air) may be admitted into the actuation chamber 106 to advance the piston assembly with the rod 94 taking up some or substantially all of the volume of the bore 88. In this position, so long as the pressure of the hydraulic fluid is not high enough to displace the piston assembly, there is little volume in the bore 88 in which hydraulic fluid can be received. The system would then behave essentially as if the pressure controller 80 were not present. However, if the pressure in the actuation chamber 106 were reduced (or if the piston 92 were driven in the opposite direction, for example by force acting on the piston from within the second chamber 108), then the piston 92 would be displaced by hydraulic fluid in the bore 88 and the rod 94 would be withdrawn from the bore 88 providing an increased volume in the bore in which hydraulic fluid may be received. In this way, the total volume of the components in which the working fluid is received (e.g. the cylinder chamber 44, passage 46, and bore 88) may be increased when the volume of the bore 88 is increased. The increased volume of the components capable of receiving the working fluid in this situation may provide a controlled reduction in the pressure of the hydraulic fluid acting on the cylinder piston rod 40, to, for example, prevent unintended pressure surges from displacing the piston rod 40. One such instance will be described below with reference to a forming cycle of the press 10 shown in FIGS. 1-4.

Figure 2:
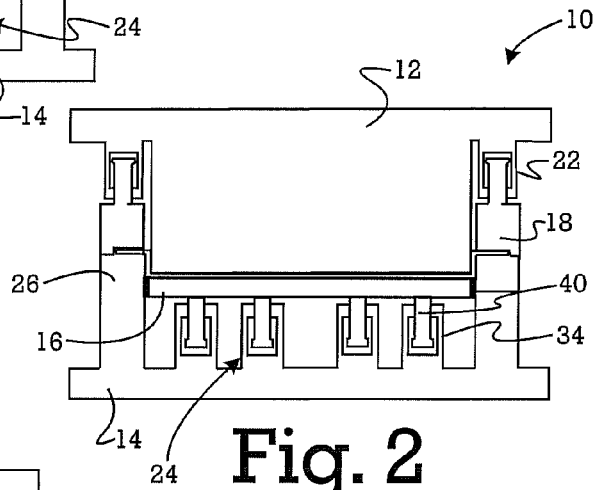
FIG. 2 is a diagrammatic side view of the forming equipment shown in an extended position to form the part.
Figure 14:
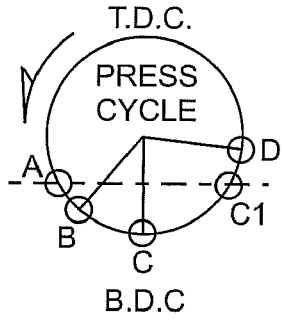
FIG. 14 is a graphical representation of a press cycle.

In a forming cycle, the press ram 12 is moved from its retracted position, shown in FIG. 1 and represented in FIG. 14 at point "T.D.C" (top dead center), to its fully advanced position, shown in FIG. 2 and represented in FIG. 14 at point C. Between T.D.C and point C, point A in FIG. 14 represents initial contact with the piston rod 40. During this movement of the ram 12, the lower pad 16 is displaced, as is the piston rod 40 of the reaction device assembly 30. As the piston rod 40 is moved further into its casing, hydraulic fluid is displaced from the pressure chamber 44, through the transfer passage 46 and check valve 62, and into the first chamber 58. During this stroke, the solenoid valve 66 may be closed (as represented by point B in FIG. 14) thereby preventing fluid flow into the first chamber 58 via the second passage 64. Fluid entering the first chamber 58 through the check valve 62 displaces the piston rod assembly 50 and thereby increases the pressure within the second chamber 60 of the accumulator 32. With the solenoid valve 66 closed, the pressure in the second chamber 60 is isolated from the pressure chamber 44 by the check valve 62 and the cylinder piston rod 40 remains in its retracted position even as the press ram 12 begins to return to its retracted position, as shown in FIG. 3 and represented by point C1 in FIG. 14. In the exemplary press 10 shown, the gas springs 22 do not initially retract with the press ram 12 such that they hold the clamp ring 18 down on the formed blank 20. Accordingly, movement of the piston rod 40 before the clamp ring 18 is permitted to move could alter the shape of or damage the formed blank 20, especially if the material of the formed blank 20 is thin, was formed to a relatively minor extent (e.g. a shallow draw) or if high precision in the forming process is required.

In such a press 10, movement of the piston rod 40 could be caused by "spring back". "Spring back" could be caused by residual pressure in the reaction device assembly 30, such as may be created when hoses, tubes or metal components are expanded during the high pressure stroke and, upon return to their unexpanded form, provide pressure in the system that moves the piston rod 40. Spring back may also be provided by decompression of the hydraulic fluid which, although considered to be incompressible, may actually compress by some small amount (typically less than a few %, with 0.5% being a representative value) under high pressure. Additional sources of spring back may include air in the system 30 and compression of other resilient components like seals. In at least some systems, total spring back may be on the order of 1% to 5% of the volume of the hydraulic fluid in the pressure chamber 44 and transfer passage 46 (that is, the fluid isolated from the first chamber 58 by the check valve 62 and solenoid valve 66).

With this in mind, the actuation chamber 106 of the pressure controller 80 is pressurized with gas (e.g. air) to drive and hold the piston rod 94 in the bore 88 such that minimal volume of the bore 88 is available to receive hydraulic fluid. When the cylinder piston rod 40 reaches its bottom or fully retracted position, the gas pressure in the actuation chamber 106 of the pressure controller 80 may be reduced, such as by opening valve 109 to permit some of the actuating fluid to leave the actuation chamber 106, so that the piston rod 94 is at least partially withdrawn from the bore 88. The volume of the bore 88 vacated by the piston rod 94 is then available to receive hydraulic fluid such that any spring back pressure in the system would simply move fluid into the bore 88, rather than into the cylinder pressure chamber 44. This will permit the pressure in the cylinder pressure chamber 44 to go to zero or slightly negative to retract the cylinder piston rod 40 further.

If total elimination of spring back is desired, it may be desirable, in view of component tolerances and the like, to design the system such that the pressure controller 80 has sufficient volume in its bore 88 to handle at least some amount more than any spring back fluid volume movement in the system (fluid volume movement in the scenario described above comes from a component returning from an expanded condition, or fluid expanding from its compressed condition). Doing so will cause the pressure in the pressure chamber 44 to become slightly less than zero when the piston rod 94 is retracted from the bore 88. In this manner, the cylinder piston rod 40 is not advanced by any such spring back pressure (that is, fluid movement and resulting pressure increase that would otherwise occur in the pressure chamber 44).

To permit the cylinder piston rod 40 to move from its retracted position (e.g. as shown in FIG. 3) toward its extended position (e.g. as shown in FIG. 4), the solenoid valve 66 is opened (as represented by point D in FIG. 14) to permit the pressurized fluid in the first chamber 58 to flow to the pressure chamber 44 through the second passage 64, the solenoid valve 66 and the transfer passage 46. The flow rate of the fluid can be controlled by providing at least a portion of the second passage 64 or the flow path through the solenoid valve 66 with a relatively small flow area to control the rate of return of the cylinder piston rod 40. When the cylinder piston rod 40 has extended, the solenoid valve 66 can be closed and the rod of the pressure controller 80 can be advanced (by introducing pressure into the actuation chamber 106) so that the reaction device assembly is ready for the next forming cycle.

Having thus described a presently preferred implementation of the reaction device assembly, various modifications and alterations will occur to those skilled in the art, which modifications and alterations will be within the scope of the invention as defined by the appended claims. For example, the reaction device assembly may be used in applications other than as described, hydraulic fluid or other pressurized fluid source could be substituted for pressurized gas in the accumulator and pressure controller and, of course, still other modifications, substitutions, and implementations may be made. Still further, while the above description of the operation of the press system and the reaction device assembly was set with regard to a single cylinder, accumulator 32 and pressure controller 80, multiple ones of each of these components may be used. As one example, one accumulator and one pressure controller 80 could be used with more than one cylinder via a manifold or other arrangement. Further, the pressure controller 80 may be communicated with a fluid chamber in which some of the working fluid may be received, rather than actually including the fluid chamber itself, as set forth above with regard to bore 88. The fluid chamber may communicate with the cylinder chamber 44 so that the fluid chamber receives working fluid from the cylinder chamber 44 to accommodate changes in pressure in the working fluid not caused by movement of the piston rod 40 to prevent unintended movement of the piston rod 40. In this regard, the pressure controller may include or be comprised of a valve that prevents flow to the fluid chamber until the piston rod 44 is fully retracted and then opens to permit some working fluid to enter the fluid chamber. Still other modifications and arrangements are possible.

The invention claimed is:

1. An apparatus, comprising:

a cylinder including a piston rod and a cylinder chamber in which a substantially, incompressible working fluid is received to resist movement of the piston rod into the cylinder chamber;

an accumulator having a first chamber in communication with the cylinder chamber to receive working fluid from the cylinder chamber upon movement of the piston rod into the cylinder chamber; and a pressure controller having a fluid chamber in which some of the working fluid may be received and continuously communicated with the cylinder chamber, an actuator operable to increase the volume of the fluid chamber when the piston rod is retracted into the cylinder chamber to increase the total volume in which the working fluid may be received, wherein the increased volume of the fluid chamber may accommodate fluid movement in the assembly not caused by movement of the piston rod, an actuation chamber in which a compressible gas is received and the actuator includes a piston with a first surface area acted upon by the gas and a second surface area acted upon by the working fluid in the fluid chamber, and wherein the pressure of the gas acting on the first surface area is sufficient to hold the piston against the pressure of working fluid acting on the second surface area while the piston rod is retracted into the cylinder chamber and movement of the piston is accomplished at least in part by reducing the pressure of the gas that acts on the first surface area.

2. The apparatus of claim 1 which also includes a second chamber disposed between the actuation chamber and the fluid chamber.

3. The apparatus of claim 2 wherein the second chamber is vented to the atmosphere.

4. The apparatus of claim 2 wherein the second chamber is arranged to receive a pressurized fluid that acts against the force of the gas in the actuation chamber.

5. The apparatus of claim 1 wherein the first surface area is greater than the second surface area.

6. The apparatus of claim 5 wherein the first surface area is between 15 and 60 times larger than the second surface area.

7. The apparatus of claim 1 which also includes a control valve communicated with the actuation chamber to selectively permit reduction of the pressure of the gas in the actuation chamber.

8. The apparatus of claim 7 wherein the control valve is closed to maintain pressure in the actuation chamber while the piston rod is moved into the cylinder chamber and the control valve is opened to reduce pressure in the actuation chamber when the piston rod reaches its fully retracted position where it is displaced furthest into the cylinder chamber.

9. The apparatus of claim 1, wherein the cylinder chamber communicates with the first chamber through a first passage and a check valve prevents fluid flow from the first chamber to the cylinder chamber through the first passage.

10. The apparatus of claim 9 wherein the cylinder chamber communicates with the first chamber through a second passage, and a second valve controls fluid flow through the second passage to selectively permit fluid flow between the first chamber and the cylinder chamber.

11. The apparatus of claim 1 wherein the second surface area is defined by an end face of a reduced diameter rod carried by the piston.

12. The apparatus of claim 1 wherein the gas is compressible air.

13. A reaction device for forming equipment, comprising:

a cylinder including a piston rod having one end extending out of the cylinder and a cylinder chamber in which a substantially incompressible working fluid is received to resist movement of the piston rod into the cylinder chamber;

an accumulator having a first chamber in communication with the cylinder chamber to receive working fluid from the cylinder chamber upon movement of the piston rod into the cylinder chamber, a second chamber in which a compressible gas is received, and a piston disposed between and defining part of both the first chamber and the second chamber; and a pressure controller communicating with a fluid chamber in which some of the working fluid may be received and having an actuator operable to increase the volume of the working fluid in the fluid chamber when the piston rod is retracted into the cylinder chamber, wherein the fluid chamber continuously communicates with the cylinder chamber and the fluid chamber receives working fluid from the cylinder chamber to accommodate changes in pressure in the working fluid not caused by movement of the piston rod to prevent unintended movement of the piston rod.

14. The reaction device of claim 13 wherein the pressure controller includes an actuation chamber in which an actuating compressible gas is received and the actuator includes a piston with a first surface area acted upon by the gas and a second surface area acted upon by the working fluid in the fluid chamber, and wherein movement of the piston is accomplished at least in part by reducing the pressure of the gas that acts on the first surface area.

15. The reaction device of claim 14 which also includes a second chamber disposed between the actuation chamber and the fluid chamber.

16. The reaction device of claim 15 wherein the second chamber is vented to the atmosphere.

17. The reaction device of claim 15 wherein the second chamber is arranged to receive a pressurized fluid that acts against the force produced by the gas in the actuation chamber.

18. The reaction device of claim 14 which also includes a control valve communicated with the actuation chamber to selectively permit reduction of the pressure of the gas in the actuation chamber.

19. The reaction device of claim 18 wherein the control valve is closed to maintain pressure in the actuation chamber while the piston rod is moved into the cylinder chamber and the control valve is opened to reduce the pressure of gas in the actuation chamber when the piston rod reaches its fully retracted position where it is displaced furthest into the cylinder chamber.

* * * * *